United States Patent [19]

Urpo et al.

[11] 4,021,810

[45] May 3, 1977

[54] TRAVELLING WAVE MEANDER CONDUCTOR ANTENNA

[76] Inventors: Seppo I. Urpo, Kalasaaksentie 3 B 22, Karakallio, Espoo; Henry Stefan Tallqvist, Lastenlinnantie 9 b C 15, Helsinki 25; Martti E. Tiuri, Takojantie 1 F, Tapiola 3, Espoo, all of Finland

[22] Filed: Dec. 22, 1975

[21] Appl. No.: 642,827

[30] Foreign Application Priority Data

Dec. 31, 1974 Finland ..... 3797/74

[52] U.S. Cl. ..... 343/731; 343/846

[51] Int. Cl.² ..... H01Q 11/02

[58] Field of Search ..... 343/846, 806, 829, 830, 343/908, 731

[56] References Cited

UNITED STATES PATENTS

| | | | |
|---|---|---|---|
| 3,377,592 | 4/1968 | Robieux et al. | 343/828 |
| 3,689,929 | 9/1972 | Moody | 343/806 |

*Primary Examiner*—Eli Lieberman

*Attorney, Agent, or Firm*—Sughrue, Rothwell, Mion, Zinn & Macpeak

[57] ABSTRACT

A travelling wave conductor antenna including a ground plane. The antenna consists of meander-structure conductors made of a conductive material, zigzagging at right angles or at almost right angles. The conductors are placed above an even or deformed ground plane and they alternately comprise portions parallel with the longitudinal axis of the antenna and portions perpendicular or almost perpendicular to said longitudinal axis so that the number of the conductors is even. The conductors are at their ends connected to an antenna feed point by means of electrically equally long or almost equally long conductors.

7 Claims, 7 Drawing Figures

TRAVELLING WAVE MEANDER CONDUCTOR ANTENNA

The present invention relates to a travelling wave antenna with a ground plane, with which the dependence of the direction of the radiation beam from the frequency can be controlled within relatively wide limits and which, in the microwave range, can be produced by means of the principle of printed circuit.

As high-gain antennas, in particular in the HF, VHF, UHF and SHF ranges, travelling wave antennas of transmission line construction are frequently used. Examples on them are the wire mesh antenna described by J. D. Kraus (U.S. Pat. No. 3,290,688) and the chain antenna suggested by the authors of the present invention (Finnish Pat. No. 48,141, U.S. Pat. No. 3,806,946). Drawbacks of the antenna construction suggested by Kraus include its relatively narrow operating frequency band and the three-dimensional structure of its wire mesh, which cannot be applied on the film of a printed circuit. A limitation of the chain antenna involves that the direction of the radiation beam depends on the frequency in a way which can be affected only little.

By means of the travelling wave antenna in accordance with the present invention, attempts are made to eliminate the above drawbacks. It is characteristic of the antenna that it is a travelling wave antenna formed by zigzagging, i.e. meander-structure, conductors above the ground plane, the radiation properties of which antenna can be controlled within relatively wide limits on the basis of the dimensions of the meander structure.

In the following detailed description of the invention, reference will be made to the following figures.

Figure 1:
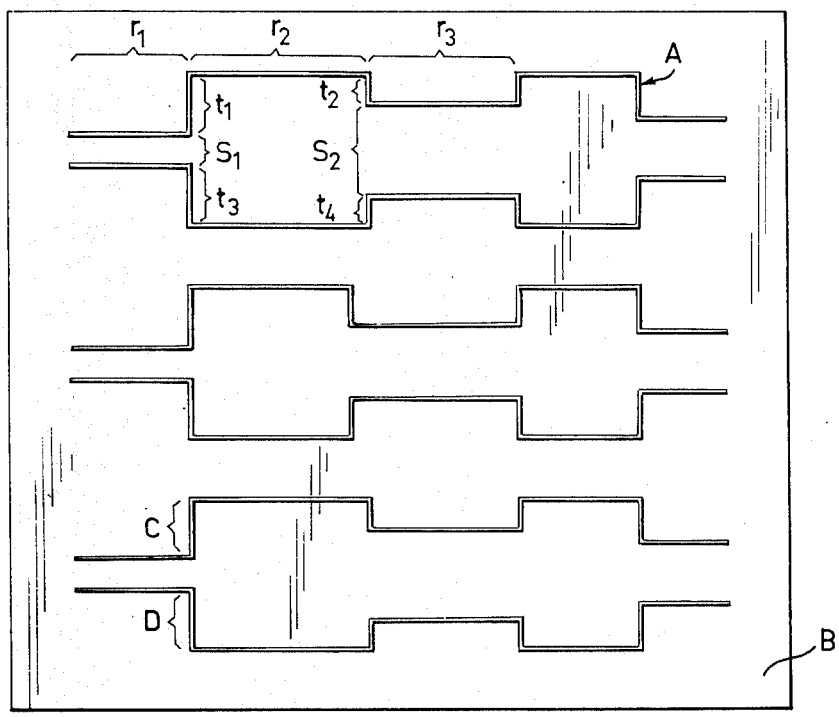

FIG. 1. A meander conductor antenna comprising six meander conductors, as viewed from above.

Figure 2:
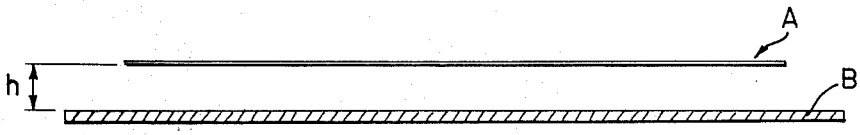

FIG. 2. A cross-section of a meander conductor antenna in the longitudinal direction of the antenna.

Figure 3:
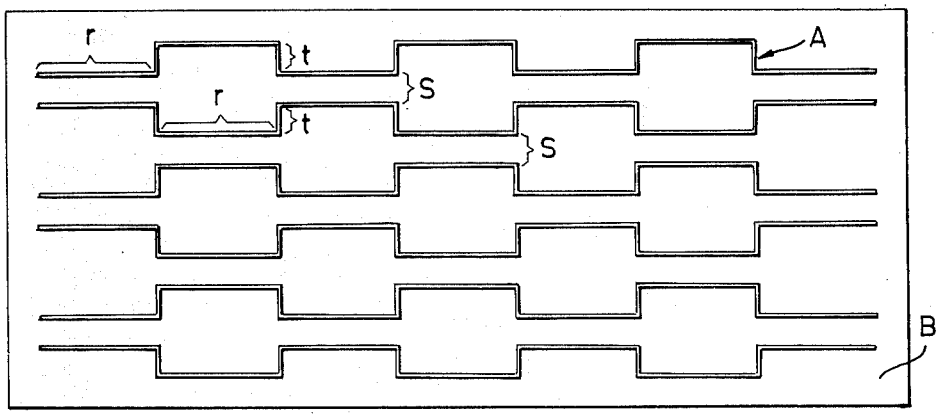

FIG. 3. A meander conductor antenna comprising six meander conductors, similar in pairs, whose smallest distance from each other, $s$, is the same.

Figure 4:
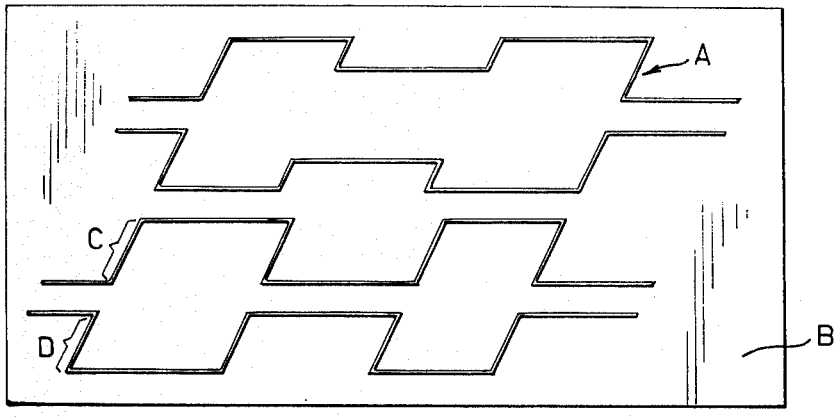

FIG. 4. A meander conductor antenna formed of conductors zigzagging with oblique angles, as viewed from above.

Figure 5:
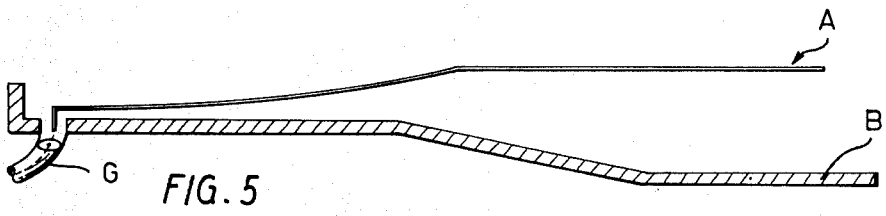

FIG. 5. A cross-section in the longitudinal direction of a meander conductor antenna in which the height of the conductor from the ground plane varies.

Figure 6:
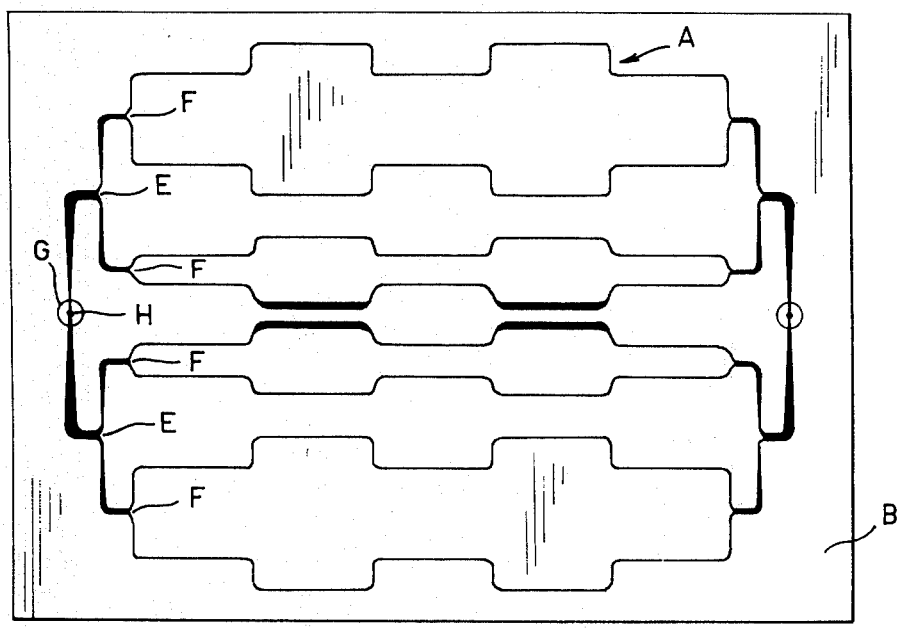

FIG. 6. An example of a matched meander conductor antenna with coaxial conductor feed, as viewed from above.

Figure 7:
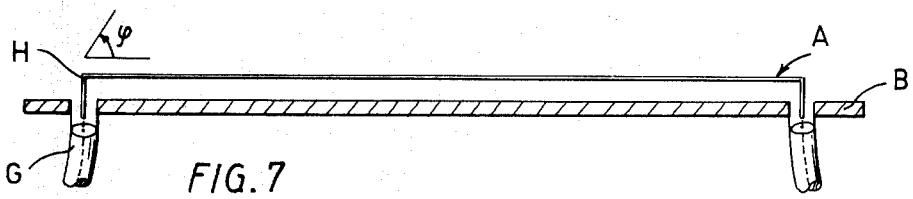

FIG. 7. Cross-section in the longituudinal direction of a meander conductor antenna with coaxial conductor feed.

With reference to FIGS. 1, 2, 3, 4, 5, 6 and 7, the antenna, in its basic form, consists of meander structures A made of a material that conducts electricity, the number of which structures is even and which are placed above a ground plane B, which conducts electricity. The antennas in FIGS. 1 and 3 include six meander conductors. The meander conductor portions $r_1$, $r_2$ etc. (FIG. 1) parallel with the longitudinal axis of the antenna will hereupon be called raidators and the other parts of the antenna, $t_1$, $t_2$ etc., transmission-conductor portions. The portions $r_1$ and $r_2$ may be equally long as compared with each other, and so may the portions $t_2$ and $t_2$, like in the antenna of FIG. 3. The portions $t_2$ and $t_3$ are equally long or almost equally long, as compared with each other, and so are the portions $t_2$ and $t_4$ correspondingly. In the antenna of FIG. 3, all the transmission-conductor portions are equally long. In a typical meander conductor antenna, the length of a radiator is 0.3 to 0.9 wave-lengths at the middle frequency, and the length of a transmission-conductor portion is 0.3 to 1.8 wave-lengths. The smallest distance of adjoining meander conductors, $s_1$, is typically 0.05 to 0.25 wave-lengths. The smallest distance between different meander conductors may be different, as is the case in the antenna of FIG. 1. In the antenna of FIG. 3 the smallest distance between all the meander conductors is equal. The meander structure may be zigzagging at almost right angles, as is shown in FIG. 1, or the angle between the transmission-conductor portions and the radiators may be oblique, as is the case in FIG. 4. The number of radiators in each meander conductor may typically range from five to several dozens. The height of the meander conductor, $h$, from the ground plane may be constant, as in the antenna of FIG. 2, or varying, as in the antenna of FIG. 5. The varying height in the antenna of FIG. 5 has been achieved at the left end by changing the height of the conductor and at the middle by bending the ground plane. Each of these methods can also be used alone. In a typical meander antenna, $h$ is 0.05 to 0.25 wave-lengths at the middle frequency.

A meander conductor antenna is fed at one of its ends, for exampel, by means of a coaxial cable G, FIGS. 5, 6 and 7, so that the conductors from the coaxial cable to the beginning of each meander conductor are electrically equally long or almost equally long. In a way known from radio technology the impedances of the connecting conductors from the end of the coaxial cable to the ends of the meander conductors can be made such that the specific impedance of the coaxial cable is matched with the antenna. A possible method of matching is suggested in FIG. 6. Therein from the end H of a coaxial cable, whose specific impedance is $Z_o$, two flat conductors are branched, the specific impedance of each of which at the branching point is $2Z_o$. The specific impedance of the flat conductors is changed by slowly widening the flat conductor so that the impedance is, at the branching point E, one half of the specific impedance of the flat conductors going on from the branching point E. On the other hand, when going to the branching points F, the impedance of these flat conductors is changed so that it is at the point F equal to the loading impedance produced by the pair of meander conductors connected in parallel at the point F. The specific impedance of the different parts of the meander conductor in relation to the ground plane can, if desired, in a way known from radio technology by changing the thickness, width, height or insulating material of the conductor, be selected so that it is at the radiator portions and at the transmission-conductor portions the same, whereby the current wave coming from the feeding points to the meander conductor proceeds along the structure almost without reflections. In the antenna of FIG. 6 the absence of reflections has been achieved by widening the radiators. The little reflections that, as is known, appear at the curve points of the conductors, can be reduced by rounding the curves, as has been done in the antenna of FIG. 6.

The typical dimensions of a meander antenna given above are only examples on tested antennas. In particular cases they may differ from those considerably without any change in the principle of operation of the antenna.

When the antenna operates, a current wave passes along the meander conductors, which wave, in a way known from the long-wire antennas, becomes weaker when passing away from the feeding point as a result of radiation and ohmic losses. the magnitude of the radiation weakening depends on the distance between the conductors and the ground plane. The radiation resulting from the current passing in the different radiator portions of the meander conductor is in a plane parallel with the longitudinal axis of the antenna and perpendicular to the ground plane in the same phase, in a direction that depends on the dimensions of the meander conductor and on the frequency. Thus, in a way known from the theory of travelling wave antennas, the radiators produce a radiation beam, whose direction depends on the dimensions of the antenna and on the frequency and can be calculated on the basis of the dimensions. For example, if the length $r$ of the radiators is 0.8 wave-lengths and the length $t$ of the transmission-conductor portions is 0.3 wave-lengths, the elevation angle of the radiation beam in relation to the ground plane, FIG. 7, is $\phi = 83°$. An approximate equation for the calculation of the direction of the radiation beam is $\cos \phi = (r + t - \lambda)/r$, when the space between the meander condcutor and the ground plane is air-insulated. The currents passing in the transmission-conductor portions, for exmple in portions C and D in FIGS. 1 and 4, are equally large but of opposite directions, so that, in a way known from the antenna technology, they annul their respective radiations in the direction of the main radiation beam, because the portions C and D are equally long or almost equally long, as compared with each other. At the most, they may cause a weak cross-polarization radiation in directions far from the main beam. It results from the protective effect of the ground plane that the mutual impedances of the various parts of the antenna are small and, according to experience, can be overlooked when the radiation properties of the antenna are determined.

By dimensioning a meander antenna, it is possible to produce desired properties. By examining the radiation properties of the antenna described above it has been ascertained, and it has been tested by means of antenna models, that if an antenna is desired whose radiation beam turns slowly when the frequency changes, the radiator length $r$ must be more than half the wave-length and the length of the transmission-conductor portions, $t$, must be less than one quarter of a wave. A radiation beam that turns rapidly as a function of frequency is obtained by selecting the radiator as considerably shorter than half the wave-length and the transmission-conductor portion, for example, as longer than one and a half wave-lengths.

The conductors of a meander conductor antenna operating in the microwave frequency, such as in the antenna of FIG. 6, can, by applying the known technology of printed circuit, be etched or printed on a plate or film of insulating material. The thickness of the plate can then be selected so that the meander conductors receive a correct distance from the ground plane when the plate is placed on the ground plane, or the ground plane may consist of a metal foil on the back surface of the plate of insulating material. Insulating material that fills the entire space between the meander conductors and the ground plane causes additional losses, as is known. In order to avoid. them, it is possible, in the antenna, to use a thin film with a printed circuit, which film is mechanically supported at the correct distance from the ground plane.

What we claimed is:

1. In a travelling wave meander conductor antenna including a ground plane, the improvement comprising: meander-structure conductors made of a conductive material, said conductors zigzagging as substantially forming open parallelograms and placed above a ground plane, which conductors alternately comprise first portions parallel with the longitudinal axis of the antenna and second portions substantially perpendicular to said longitudinal axis so that the number of conductors is even, said conductors being connected at their respective ends to an antenna feed point by means of electrically substantially equally long conductors.

2. A meander conductor antenna as claimed in claim 1, characterized in that the second portions of the conductors in the antenna form an oblique angle with the longitudinal direction.

3. A meander conductor antenna as claimed in claim 1, characterized in that the height from the ground plane, the width, and the insulation material of the meander conductors is dimensioned so that the current wave passes along the conductors almost without reflections.

4. A meander conductor antenna as claimed in claim 1, characterized in that the meander conductors are, made on a plate or insulating material.

5. A meander conductor antenna as claimed in claim 4, characterized in that both the meander conductors and the ground plane are made on the same plate of insulating material.

6. The meander conductor antenna as claimed in claim 1 wherein said conductors are placed above a deformed ground plane.

7. A meander conductor antenna as claimed in claim 1 wherein said meander conductors are made on a film of insulating material.

* * * * *